US005222782A

United States Patent [19]

Shrader

[11] Patent Number: 5,222,782

[45] Date of Patent: Jun. 29, 1993

[54] STADIUM CHAIR ASSEMBLY

[76] Inventor: Stacy J. Shrader, 9777 Lamoreaux, Fowlerville, Mich. 43336

[21] Appl. No.: 783,783

[22] Filed: Oct. 29, 1991

[51] Int. Cl.[5] ..... A47C 3/16

[52] U.S. Cl. ..... 297/252; 297/192; 297/250; 297/352

[58] Field of Search ..... 297/352, 252, 253, 254, 297/191, 192, 193, 230, 250, 232, 243

[56] References Cited

U.S. PATENT DOCUMENTS

| | | | |
|---|---|---|---|
| 859,560 | 7/1907 | Hyde | 297/352 |
| 2,237,736 | 4/1941 | Hill | 297/352 |
| 2,280,231 | 4/1942 | Gulley | 297/352 |
| 2,518,057 | 8/1950 | Orth | 297/352 |
| 3,120,404 | 2/1964 | Bramming | 297/252 X |
| 3,310,341 | 3/1967 | Connell . | |
| 3,519,307 | 7/1970 | Gittings . | |
| 3,560,047 | 2/1971 | Davis | 297/252 X |
| 3,994,529 | 11/1976 | Lippert . | |
| 4,068,889 | 1/1978 | Pierce et al. . | |
| 4,079,993 | 3/1978 | Pierce . | |
| 4,611,852 | 9/1981 | Filer . | |
| 4,652,048 | 3/1987 | Mazar | 297/192 |
| 4,674,631 | 6/1987 | Williams . | |
| 4,781,413 | 11/1988 | Shumack, Jr. . | |
| 4,799,731 | 1/1989 | Brown . | |
| 4,871,209 | 10/1989 | Handelman . | |

FOREIGN PATENT DOCUMENTS

| | | | |
|---|---|---|---|
| 560834 | 9/1957 | Belgium | 297/252 |

*Primary Examiner*—Peter R. Brown

*Attorney, Agent, or Firm*—Gifford, Groh, Sprinkle, Patmore and Anderson

[57] ABSTRACT

A stadium chair assembly for use in combination with existing rows of colinear bleacher seats comprising a forward row and a rearward row of backless bleachers. Two embodiments are preferred, the first being a one-piece seat having a ribbed base for gripping a forward bleacher and a back that is rested upon the front portion of the rearward bleacher. The second embodiment is a two-piece seat assembly the seat back of which is pivotably attached to a seat support structure that extends from the seat back to the bleacher floor behind the forward bleacher and in front of the rearward bleacher. The support structure may be hollow and insulated to provide storage space for cold beverages or hot food.

18 Claims, 3 Drawing Sheets

STADIUM CHAIR ASSEMBLY

BACKGROUND OF THE INVENTION

I. Field of the Invention

The present invention relates generally to a stadium seat for use with conventional and existing backless stadium bleachers. More particularly, the present invention relates to such a chair assembly that relies either upon a rearward bleacher or upon the floor between a forward bleacher and a rearward bleacher for support. The first type preferably includes ribbing for gripping the top of the forward bleacher and a back for resting upon the front edge of the rearward bleacher. The second type includes a support structure fitted to the back of the seat and extending to the floor disposed between the forward bleacher and the rearward bleacher.

II. Description of the Prior Art

The use of the stadium for use in observing sporting events is very ancient. The word "stadium" itself is from the Greek word "spadion" meaning "racetrack", this origin attesting also to the antiquity of the stadium.

Early "stadia" included seats composed of a durable (if uncomfortable) substance such as marble. The seats were placed in rows, with each succeeding row being situated at a higher level than the one before it, thereby allowing for all persons in attendance to have a view of the sporting activity.

Both sporting events and the stadium have changed considerably since those early days. In particular, the materials from which the stadium and its seats are composed have changed. The modern stadium includes seats that are typically composed of steel, aluminum, or a polymerized material such as fiber glass or a plastic. The present bleacher seats are backless, as were their ancestors.

While different in material, present bleachers share at least two characteristics with their predecessors. First, like the ancient seats, modern seats are durable. Second, again like the ancient seats, modern seats are remarkably uncomfortable.

Several efforts have been made to render modern bleacher seats comfortable. These approaches include the provision of a portable seat that may be placed upon the existing bleacher.

In particular, U.S. Pat. No. 4,079,993 issued to Pierce on Mar. 21, 1978, discloses a one-piece back rest oz which attaches to the back end of a bleacher seat to provide back support. However, while Pierce provides support, it fails to provide any comfort.

In resolving the problem of minimal comfort, attempts were made to provide both support and comfort. For example, U.S. Pat. No. 3,994,529 issued to Lippert on Nov. 30, 1976, discloses a foldable stadium seat having webbing on its base and back.

In U.S. Pat. No. 3,310,341, issued to Connell on Mar. 21, 1967, a portable stadium seat is disclosed that comprises a padded base and back that fold onto one another. Similarly, in U.S. Pat. No. 4,781,413, issued to Shumack on Nov. 1, 1988, a foldable and extensively padded portable stadium seat is disclosed.

However, those advantages that the padded seats of these patents gain in comfort they sacrifice in being too complex. This complexity adds to weight and compromises durability.

Accordingly, prior approaches to providing a portable stadium seat that is both comfortable and simple have failed.

SUMMARY OF THE PRESENT INVENTION

The present invention provides a stadium chair assembly for use in combination with a pair of selected seats found in colinear rows of bleacher seats comprising a forward row and a rearward row of backless bleachers. Such bleachers typically have a flat top surface, a front surface, and a back surface.

The chair assembly of the present invention is provided in two preferred embodiments.

The first is a one-piece seat preferably having on its underside a series of parallel ribs for frictionally engaging the top side and edges of a bleacher seat. According to this embodiment, the seat back may also include such ribs on its back side to grippingly engage the rearward bleacher of the colinear pair of bleachers, thereby relying upon the rearward bleacher for lateral support.

The one-piece seat embodiment includes a hard plastic seat back and base with a soft surface disposed on the top thereof.

The second of the two preferred embodiments is a chair assembly having a chair portion the base of which may be rested substantially upon the top side of the forward bleacher. The seat back of this embodiment has disposed on its back side a seat support structure which extends to the floor found between the forward and rearward seats. The support structure may be hollow for storage of cold beverages or hot food. The seat may be hinged to the support structure, thereby serving as both seat and cover, or may be removably attachable to the top of the support structure which would accordingly have its own built-in cover. Insulation disposed within the walls of the support structure may be provided when employed for this purpose. The front and back corners of the bottom end of the support structure may be curved to accomodate a rocking motion as desirably produced by the user.

The present invention overcomes the problems and disadvantages commonly associated with known stadium chairs in that the chair assembly of the present invention is convenient, comfortable and lacks the burdensome complexity of known chairs.

Other advantages and features of the present invention will become more apparent from the following detailed description.

BRIEF DESCRIPTION OF THE DRAWING

The present invention will be more fully understood by reference to the following detailed description of the preferred embodiments of the present invention when read in conjunction with the accompanying drawing, in which like reference characters refer to like parts throughout the views, and in which.

DETAILED DESCRIPTION OF THE PREFERRED EMBODIMENTS OF THE PRESENT INVENTION

The drawings disclose the preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Figure 1:
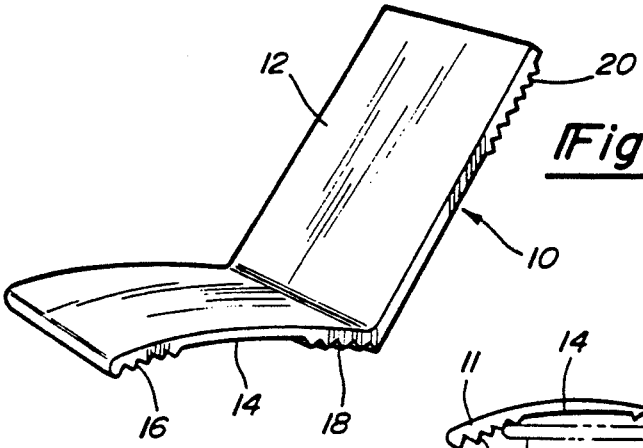
FIG. 1 is a perspective view of a first embodiment of the invention.

Referring to FIG. 1, a first embodiment of a stadium chair according to the present invention is illustrated. This particular embodiment is a one-piece unit, generally indicated as 10. The unit 10 includes a back 12 and a base 14. The unit 10 is preferably composed of a flexible, medium soft polymerized material such as a rubber or plastic. A metal or fiberglass internal skeleton (not shown) may be provided. Preferably the base 14 is flexible. The unit 10 may include a soft surface 11 composed of a resilient material such as a foam rubber. (See FIG. 2.) In any event, the object of the construction is that the unit 10 be firm enough for support while being soft enough to provide comfort.

On the underside of the base 14 are provided a plurality of ribs. The ribs may comprise a front set 16 and a back set 18. The ribs provide a means by which the chair 10 grips the underlying bleacher seat (see FIG. 2).

Figure 2:
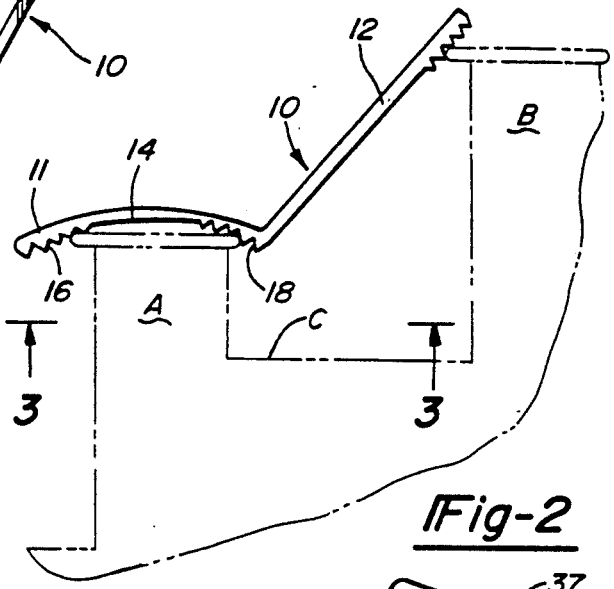
FIG. 2 elevational view of the embodiment illustrated in FIG. 1 in place between bleacher seats.

With reference to FIG. 2, a forward bleacher seat "A" is provided as is a rearward bleacher seat "B". Interconnecting the seats "A" and "B" is a floor "C". The configuration and construction of seats "A" and "B" and the floor "C" is very conventional and is one that can be found in most stadiums.

As can be more fully understood by reference to FIG. 2, the rib sets 16 and 18 are readily able to grip the seat of the bleacher "A". As an alternative, only grip set 18 need be provided as this construction provides an adequate hold upon the seat "A". However, presence of the two sets of ribs 16 and 18 provides maximum hold onto the seat "A".

The back 12 of the unit 10 rests upon the seat "B" which provides sound back support. As a further modification of the unit 10, an additional set of ribs 20 may be provided to maximize the hold upon the seat "B".

In the event that the seats "A" and "B" are separated by a greater or lesser distance than illustrated, the joint region connecting the back 12 and the base 14 is allowed to flex somewhat to accomodate this difference. Additionally, this same flexing action may also accomodate seats "A" and "B" having different heights with respect to one another.

Figure 3:
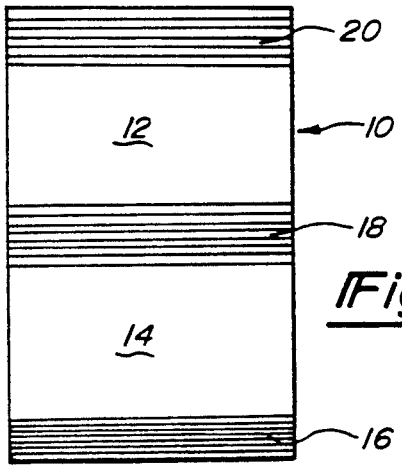
FIG. 3 view taken along line 3—3 of FIG. 2 disclosing the underside of the embodiment of FIGS. 1 and 2.

FIG. 3 is a view taken along line 3—3 of FIG. 2. This view illustrates more fully the design of the ribs 16, 18, 20 and their disposition upon the underside of the unit 10.

Figure 4:
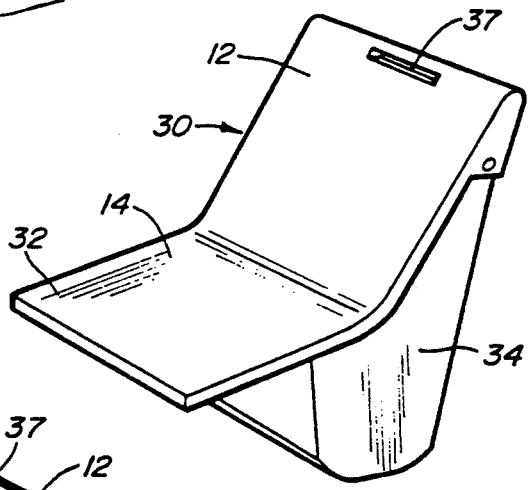
FIG. 4 is a perspective view of a second embodiment of the present invention in its closed position.
Figure 5:
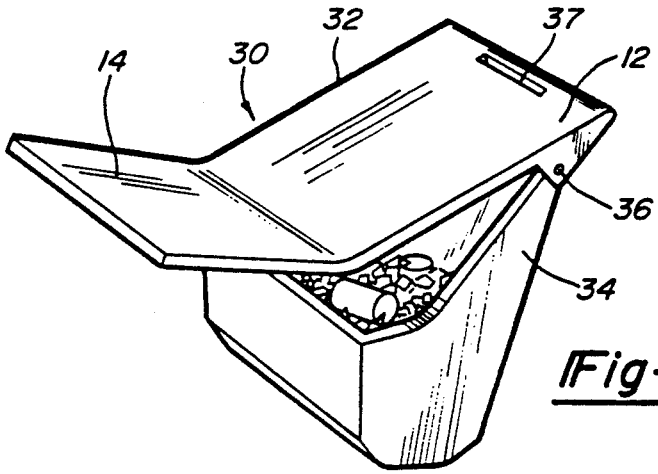
FIG. 5 is a view similar to that of FIG. 4 showing the second e in its open position.

FIGS. 4–8 disclose a second embodiment of a stadium chair in two alternate, but similar, constructions according to the present invention. FIGS. 4 and 5 disclose a two-piece unit, generally illustrated as 30. The unit 30 includes a seat 32 interconnected with a base 34.

According to this embodiment the seat is similar in construction to the seat of the unit 10 as described above with respect to FIGS. 1–3, and may be composed of a polymerized material such as a plastic or a rubber. Again, an internal skeleton (not shown) may be provided. A handle 37 is optionally provided for ease of carrying.

The seat 32 and the base 34 may be fixedly connected as shown in FIG. 4, or they may be hingedly attached. This latter construction is illustrated in FIG. 5.

With respect thereto, FIG. 5 shows a base 34 that doubles as a cooler. According to this construction, the seat 32 and the base 34 are hingedly interconnected at hinge 36. A hollow air space may be provided within the walls, or insulation may be disposed therein (neither shown). The base 34 need not even act as a cooler, but may provide a portable storage space for sporting equipment or clothing.

Figure 8:
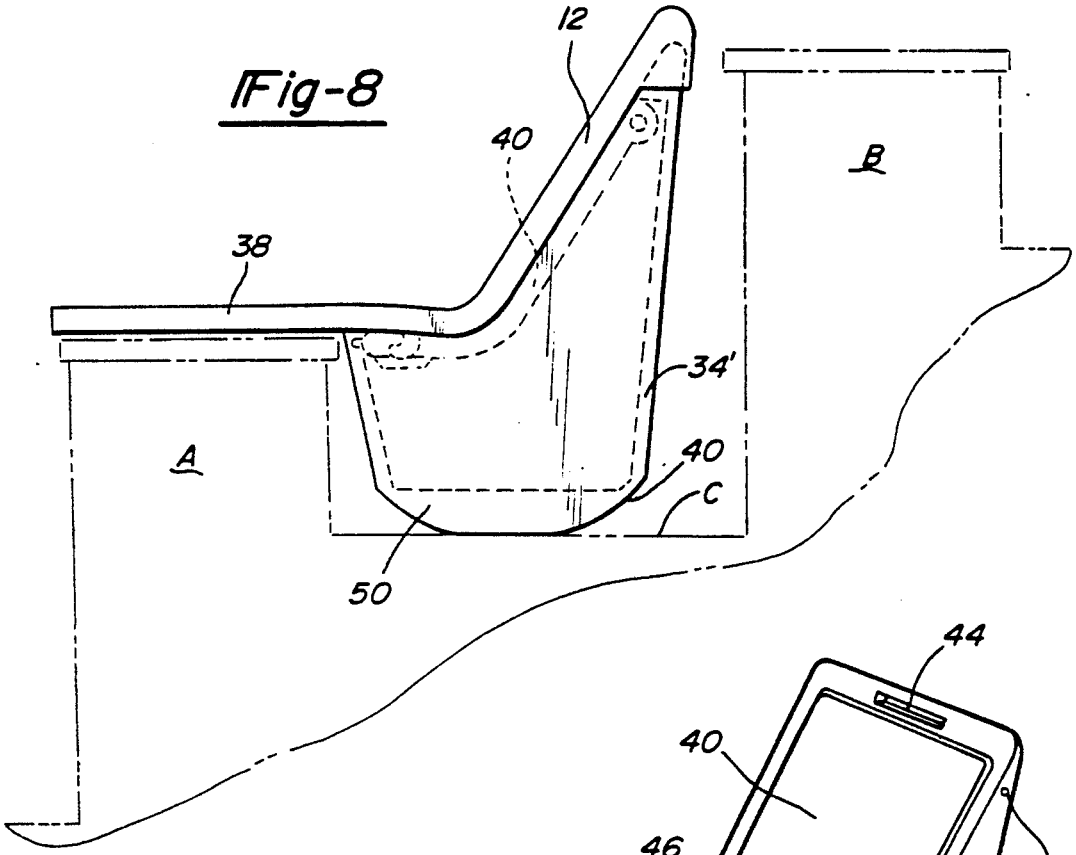
FIG. 8 elevational view of the embodiment illustrated in FIGS. 6 and 7 and disclosing the chair assembly in place between bleacher seats.
Figure 6:
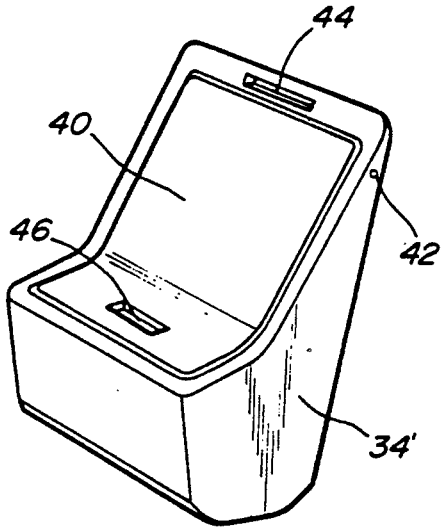
FIG. 6 is a perspective view of the second embodiment without seat cover.
Figure 7:
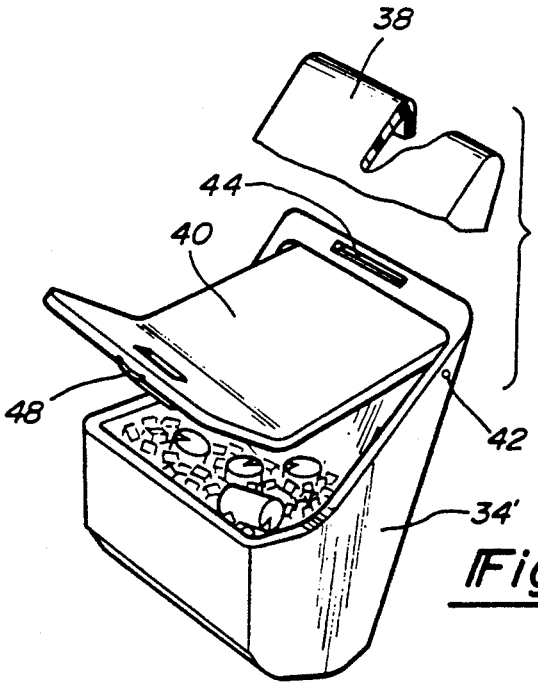
FIG. 7 is similar to the view of FIG. 6 but showing a portion of the seat cover and the lid of the support structure in its open position.

FIGS. 6 through 8 disclose a modification of the embodiment illustrated in FIGS. 4 and 5. According to the modification, and with respect to FIG. 6, a base 34' is illustrated. The base 34' is similar to the base 34 of FIGS. 4 and 5, but does not have the seat 32 fixed thereto. Instead, according to this modification, a seat cover 38 (shown in FIGS. 7 and 8) is removably attachable to the base 34'.

Still referring to FIG. 6, the base 34' includes a cover 40. The cover 40 is pivotably attached to the base 34' at pivot points 42. As illustrated, the cover 40 is itself contoured to both receive the seat cover 38 and to function as a seat without the seat cover 38. The seat cover 38 is preferably composed of a pliable polymerized material.

A handle 44 is defined in the top end of the base 34' to allow for mobility of the base 34'.

Referring to FIG. 7, the cover 40 is shown in its open position relative to the base 34'. Like the base 34 shown above with respect to FIGS. 4 and 5, the base 34' of the illustrated modification provides an insulated storage area for food and drink.

As illustrated, the seat cover 38 may be removed from the base 34'.

The cover 40 includes a recessed handle 46 to facilitate convenient opening and closing. A latch mechanism 48 is preferably fitted for locking.

FIG. 8 illustrates the second ("cooler") embodiment in place between the conventional forward bleacher "A" and rearward bleacher "B". According to this embodiment, the back 12 does not rest against the seat "B", but instead is supported by the base 34' (or 34) as it rests upon the floor "C".

The modification of the second embodiment is illustrated here having the seat cover 38, although the unmodified version of FIGS. 4 and 5 would work here as well. (The broken line within the base represents the storage space defined according to cooler embodiment.) Rounded corners 50, 40 may be provided to allow the user to rock back and forth if desired.

Figure 9:
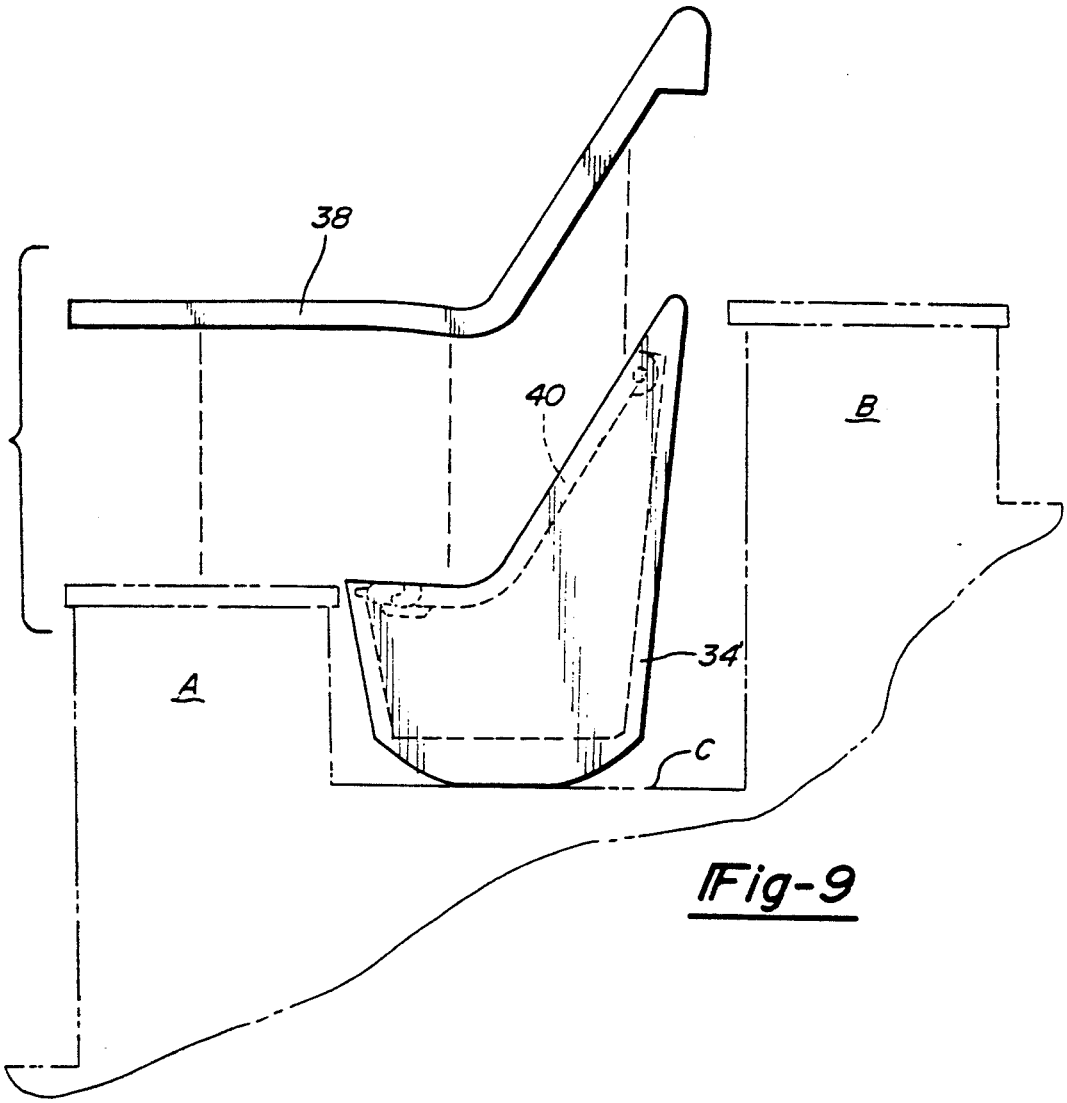
FIG. 9 is an elevational view similar to that of FIG. 8 but showing the seat separated from the support structure.

Referring to FIG. 9, the seat cover 38 separated from the base 34' is illustrated. This embodiment is also partially shown in FIG. 7. Attachment of the seat cover 38 and the base 34' is accomplished by conventional means known to those skilled in the art.

Having described my invention, however, many modifications thereto will become apparent to those skilled in the art to which it pertains without deviation from the spirit of the invention as defined by the scope of the appended claims.

I claim:

1. In combination with an existing row of conventional colinear stadium bleacher seats comprising a forward row and a rearward row of backless bleachers having a flat top surface, a front surface, and a back surface, a stadium chair assembly comprising:

a seat, said seat including a seat base and a seat back;

said seat base having a front portion and a back portion;

said seat back having an upper portion and a lower portion, said lower portion being attached to said back portion of said seat base;

said seat back including a back side, said back side of said seat back including means for positioning said seat back upon the front surface of said rearward bleacher; and said seat back being situated substantially between said front and back bleachers when said assembly is used therewith;

said seat being of one-piece construction and said seat base and said seat back having a fixed relation to one another whereby said seat base and said seat back maintain a constant angle with respect to each other.

2. The stadium chair assembly according to claim 1 wherein said constant angle is an obtuse angle.

3. The stadium chair assembly according to claim 2 wherein said back portion of said base extends beyond said back surface of said bleacher.

4. The stadium chair assembly of claim 1 wherein said seat base includes an upper side and a lower side, said lower side including means for gripping said forward bleacher.

5. The stadium chair assembly of claim 4 wherein said means for gripping comprises at least one rib.

6. The stadium chair assembly of claim 5 wherein said back side of said seat back includes means for gripping the front surface of said rearward bleacher.

7. The stadium chair assembly of claim 7 wherein said means for gripping comprises at least one rib.

8. The stadium chair assembly of claim 1 wherein said seat base is composed of a flexible material.

9. The stadium chair assembly of claim 1 wherein said existing row of stadium bleacher seats rests upon a floor and wherein said assembly further includes means for providing chair-to-floor support, said means being attached to said back portion of said seat back.

10. A stadium chair assembly adapted for use with conventional colinear stadium bleacher seats and a floor upon which said seats rest, said row of seats comprising a forward row and a rearward row of backless bleachers having a flat top surface, a front surface, and a back surface, said assembly comprising:

a seat, said seat including a seat base and a seat back;

said seat base having a front portion and a back portion;

said seat back having an upper portion and a lower portion, said lower portion being attached to said back portion of said seat base;

said back being disposed at an obtuse angle relative to said base;

said back portion of said base extending beyond said back surface of said bleacher; and said assembly further including means for providing chair-to-floor support, said chair-to-floor support comprising a support structure extending from said seat back;

said seat being of one-piece construction and said seat base and said seat back having a fixed relation to one another whereby said seat base and said seat back maintain a constant angle with respect to each other.

11. The stadium chair assembly of claim 10 wherein said support structure is substantially hollow.

12. The stadium chair assembly of claim 11 wherein said support structure includes an insulating liner.

13. The stadium chair assembly of claim 10 wherein said support structure is removably attached to said seat back.

14. The stadium chair assembly of claim 10 wherein said support structure is pivotably attached to said seat back.

15. The stadium chair assembly of claim 10 wherein said support structure includes a floor-abutting base end, said base end having rounded corners.

16. The stadium chair assembly of claim 10 wherein said back is situated between said front and back bleachers when said assembly is used therebetween.

17. A stadium chair assembly adapted for use with conventional colinear stadium bleacher seats and a floor upon which said seats rest, said row of seats comprising a forward row and a rearward row of backless bleachers having a flat top surface, a front surface, and a back surface, said assembly comprising:

a seat, said seat including a seat base and a seat back;

said seat base having a front portion and a back portion;

said seat back having an upper portion and a lower portion, said lower portion being attached to said back portion of said seat base;

said back being disposed at an obtuse angle relative to said base;

said back portion of said base extending beyond said back surface of said bleacher chair;

said seat back being situated between said front and back bleachers when said assembly is used therewith; and said assembly further including means for providing chair-to-floor support, said chair-to-floor support comprising a support structure extending from said seat back;

said seat being of one-piece construction and said seat base and said seat back having a fixed relation to one another whereby said seat base and said seat back maintain a constant angle with respect to each other.

18. In combination with an existing row of conventional colinear stadium bleacher seats resting upon a floor comprising a forward row and a rearward row and a rearward row of backless bleachers having a flat top surface, a front surface, and a back surface, a stadium chair assembly comprising:

a seat base having a front portion and a back portion;

said seat back having an upper portion and a lower portion, said lower portion being attached to said back portion of said seat base;

said seat back including a back side, said back side of said seat back including means for positioning said seat back upon the front surface of said rearward bleacher; and said seat back being situated substantially between said front and back bleachers when said assembly is used therewith;

said assembly further including means for providing chair-to-floor support, said means for providing chair-to-floor support comprising a support structure extending from said seat back;

said support structure extending from said back portion of said seat base;

said support structure being substantially hollow; and said support structure including an insulating liner.

* * * * *

UNITED STATES PATENT AND TRADEMARK OFFICE

CERTIFICATE OF CORRECTION

PATENT NO. : 5,222,782

DATED : June 29, 1993

INVENTOR(S) : Stacy J. Shrader

It is certified that error appears in the above-identified patent and that said Letters Patent is hereby Title Page:
Item 76, Inventor: delete "43336" and insert -- 48836 --.

Item 56, References Cited: delete "Mazar" and insert -- Nazar --.

Column 1, line 49, delete "oz".

Column 2, line 58, after "the" insert -- present --.

line 59, after "2" insert -- is an --.

line 60, after "3" insert -- is a --.

line 66, delete "e" and insert -- embodiment --.

line 68, after "without" insert -- a removable --.

Column 3, line 4, after "8" insert -- is an --.

UNITED STATES PATENT AND TRADEMARK OFFICE

CERTIFICATE OF CORRECTION

PATENT NO. : 5,222,782

DATED : June 29, 1993

INVENTOR(S) : Stacy J. Shrader

It is certified that error appears in the above-identified patent and that said Letters Patent is hereby corrected as shown below:

Column 6, line 3, delete "one-piece" and insert -- one-pieced --.

Column 6, line 59, delete "said" and insert -- a --.

Signed and Sealed this

Nineteenth Day of July, 1994

Bruce Lehman

*Attest:*

BRUCE LEHMAN

*Attesting Officer*

*Commissioner of Patents and Trademarks*